US006217244B1

(12) United States Patent
Chen et al.

(10) Patent No.: US 6,217,244 B1
(45) Date of Patent: Apr. 17, 2001

(54) SPONGE MOP WITH A CLEANING TANK ATTACHED THERETO

(76) Inventors: He-Jin Chen, No. 17, Alley 33, Lane 24, Sec 3, Chung Yang Road, Lung-Ching Hsiang; Chia-Yi Hsieh, No. 357-2, Chung Hua Road, Wu-Chi Town, both of Taichung Hsien (TW)

( * ) Notice: Subject to any disclaimer, the term of this patent is extended or adjusted under 35 U.S.C. 154(b) by 0 days.

(21) Appl. No.: 09/572,292

(22) Filed: May 17, 2000

(51) Int. Cl.[7] ..... A46B 11/00

(52) U.S. Cl. ..... 401/140; 401/136; 401/270; 401/282; 15/119.2

(58) Field of Search ..... 401/140, 136, 401/270, 282; 15/152, 151, 150, 119.2

(56) References Cited

U.S. PATENT DOCUMENTS 1,065,975 * 7/1913 Shaw ..... 401/140
1,122,079 * 12/1914 Cunneen ..... 401/140
2,187,671 * 1/1940 Suddarth ..... 401/140
3,210,794 * 10/1965 Vosbikian ..... 401/140
4,654,920 * 4/1987 O'Neil, Jr. et al. ..... 15/119 A

* cited by examiner

*Primary Examiner*—David J. Walczak
(74) *Attorney, Agent, or Firm*—Bacon & Thomas

(57) ABSTRACT

A sponge mop includes a post extending through a top of a frame and the frame has two extensions on each of which a roller is connected. A sponge is located between the two rollers. A lever handle is pivotally connected to the post and a link is fixedly connected between the lever handle and the ridge. A tank is connected to the post and receives cleaning detergent therein. An outlet extends from a lower end of the tank and is engaged with the hole in the frame. A seal member is removably engaged with the outlet and a control assembly is received in the tank. A lower end of the control assembly is connected to the seal member and an operation handle on a top of the control assembly is engaged with the top hole so that when rotating the operation handle, the detergent flows to the sponge.

7 Claims, 9 Drawing Sheets

SPONGE MOP WITH A CLEANING TANK ATTACHED THERETO

FIELD OF THE INVENTION

The present invention relates to a sponge mop having a cleaning tank attached thereto so as to let the detergent in the tank flow to the sponge to enhance cleaning feature of the sponge mop.

BACKGROUND OF THE INVENTION

A conventional sponge mop is shown in FIG. 9 and generally includes a post 70 having a handle 71 connected to top section of the post 70 and an operation frame connected to a lower section of the post 70. The operation frame includes a lever member 77 with two arms 78 connected to the post 70, and two links 76 pivotably connected to the two arms 78. A squeezing assembly 72 includes three pairs of rollers 74 and a sponge 75 has its a ridge 73 on a top of the sponge 75 so that the ridge 73 is located between the three pairs of rollers 74. The two links 76 extend through the squeezing assembly 72 and are fixedly connected to the ridge 73. When pulling the lever member 77 upward, the two links 76 will lift the sponge 75 to be squeezed between the rollers 74 so that the contaminated water absorbed in the sponge 75 is squeezed out from the sponge 75. Nevertheless, the user always uses detergent to remove the dirty portion on the ground or the floor before using the sponge mop. In other words, most of the dirty portion cannot be removed by simply using water so that the users have to take two separate actions and use different tools to deal with the dirty portions.

The present invention intends to provide a sponge mop that has a cleaning tank connected thereto and the detergent in the tank is easily operated to flow into the sponge by operating a lever handle on the tank to enhance cleaning feature.

SUMMARY OF THE INVENTION

In accordance with one aspect of the present invention, there is provided a sponge mop and comprising a post having a first end extending through a top of a frame. The frame has two extensions and each extension has a roller connected thereto. A ridge extends from a top of the sponge and is movably located between the two extensions of the frame. A hole is defined through a top of the frame. A lever handle is pivotally connected to the post and a link is fixedly connected between the lever handle and the ridge. A tank is connected to the post and has an outlet extending from a lower end of the tank. The outlet is engaged with the hole in the frame and a seal member is removably engaged with the outlet. A top hole is defined in a top of the tank and a control assembly is received in the tank. A lower end of the control assembly is connected to the seal member and an operation handle is on a top of the control assembly which is engaged with the top hole.

The object of the present invention is to provide a sponge mop with a detergent tank connected to the post of the sponge mop so that the detergent in the tank flows to the sponge.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENT

Figure 1:
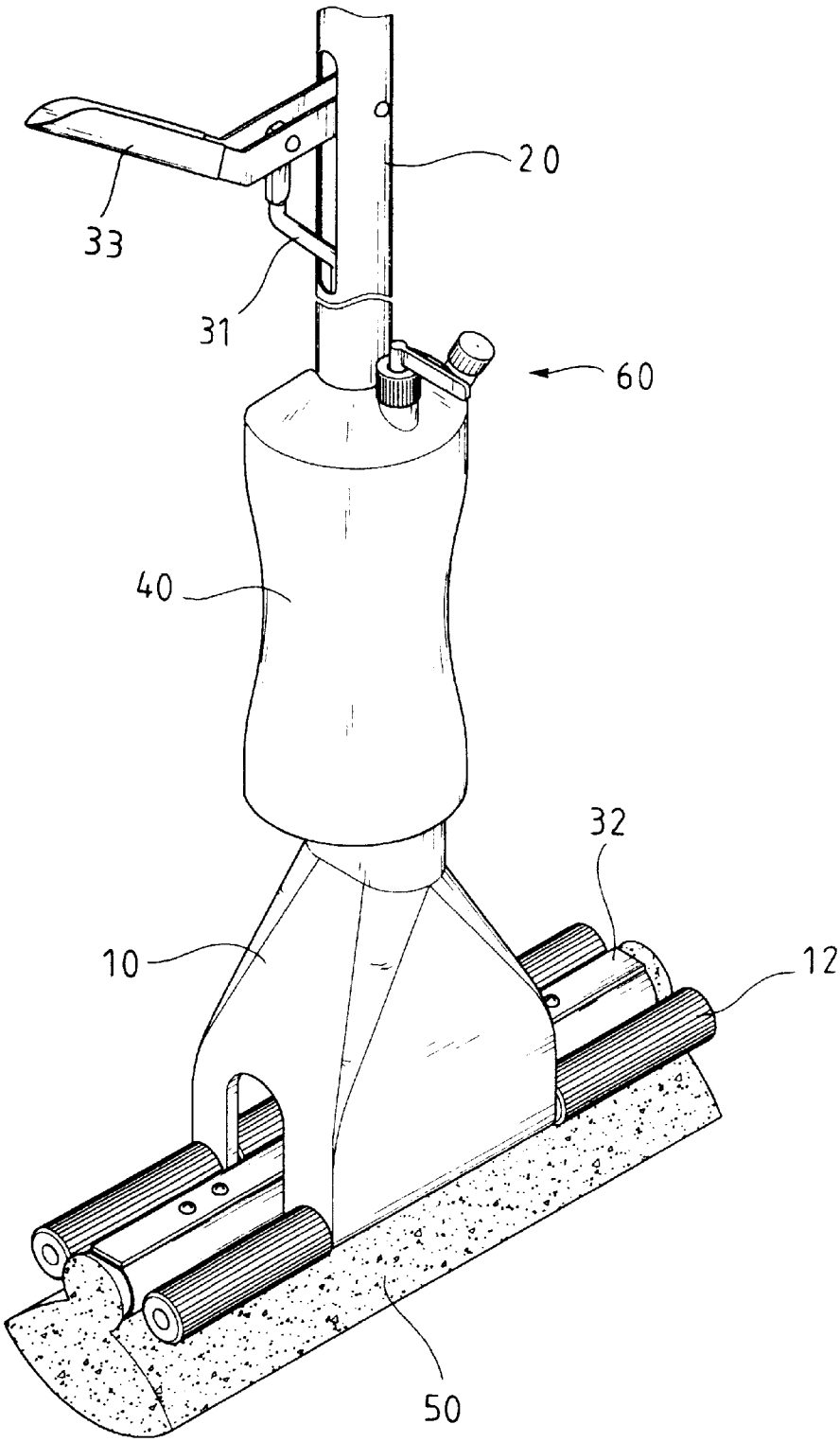
FIG. 1 is a perspective view to show a sponge mop of the present invention.

Referring to FIGS. 1 to 5, the sponge mop in accordance with the present invention comprises a post 20 having a first end extending through a hole 14 defined through top of a frame 10, and a second end of the post 20 is a handle (not shown). The frame 10 has two extensions 11 and each extension 11 has a pin 13 extending therethrough so that three pairs of roller 12 are connected to the two pins 13. A sponge 50 is located between the two extensions 11 and a ridge 51 extends from a top of the sponge 50. The ridge 51 extends from a top of the sponge 50 and the ridge 51 is movably located between the two extensions 11 of the frame 10. A hole 15 is defined through a top of the frame 10. The post 20 has a slot 21 defined in a periphery thereof and an end of a lever handle 33 is inserted in the slot 21 and pivotally connected to the post 20. A link 31 is movably received in the post 20 and an end is pivotally connected to the lever handle 33 via the slot 21 and the other end of the link 31 is fixedly connected to a plate 32 which is fixedly connected to the ridge 51 of the sponge 50.

A tank 40 is connected to the post 20 and has an outlet 43 extending from a lower end of the tank 40. The outlet 43 is engaged with the hole 15 in the frame 10 and a seal member 62 is removably engaged with the outlet 43. A top hole 44 and an inlet 46 are respectively defined in the top of the tank 40. A control assembly 60 is received in the tank 40 and a cap 48 is threadedly connected to the inlet 46. The cap 48 has a transparent top 47 so as to check the volume of detergent in the tank 40. A lower end of the control assembly 60 is connected to the seal member 62 and an operation handle 65 is on a top of the control assembly 60 which is engaged with the top hole 44. A groove 41 is defined in a side of the tank 40 and the post 20 is engaged with the groove 41 of the tank 40. Four protrusions 42 extend from an inside of the groove 41 of the tank 40 to let the post 20 be securely engaged with the groove 41.

The control assembly 60 comprises a rod 61 and a lower end of the rod 61 is fixedly connected to the seal member 62. A threaded portion 611 is on a top end of the rod 61 and an engaging end 612 extends from a top end of the rod 61. The engaging end 612 has a surface and extends from the top hole 44 and the operation handle 65 is connected to the engaging end 612. A collar 63 is fixedly engaged with the top hole 44 and has a threaded inner periphery. The threaded portion 611 is threadedly engaged with the threaded inner periphery of the collar 63. Two bosses 631 extend radially outward from the collar 63 and two notches 440 are defined in an inner periphery of the top hole 44 so that the two bosses 631 are engaged with the two notches 440. A tubular member 45 extends from a periphery of the top hole 44 and a threaded section is defined in an outer periphery to which a sleeve 64 is mounted to prevent the collar 63 from removing from the top hole 44.

Figure 2:
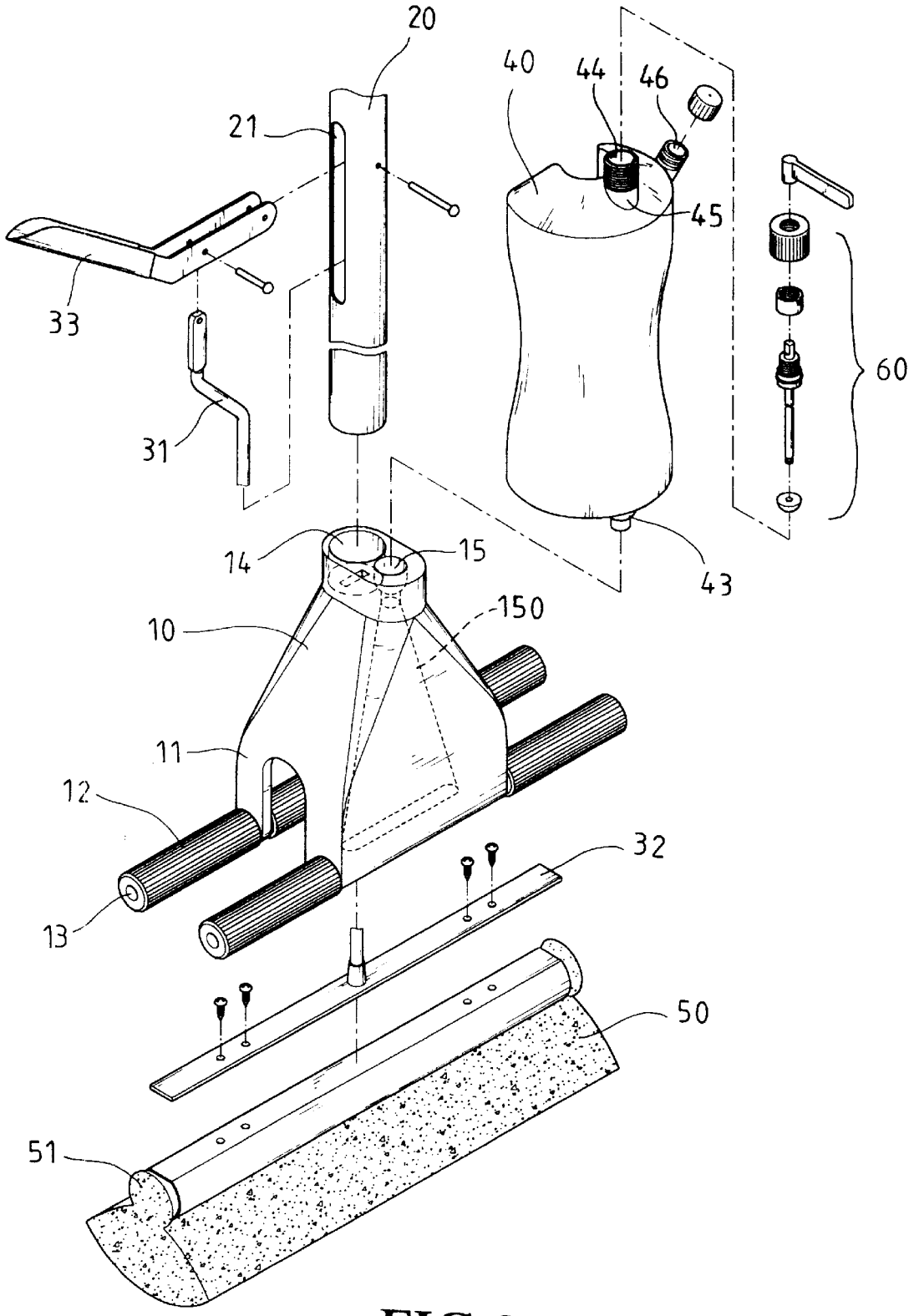
FIG. 2 is an exploded view to show the sponge mop and a detergent tank connected to the sponge mop of the invention.
Figure 3:
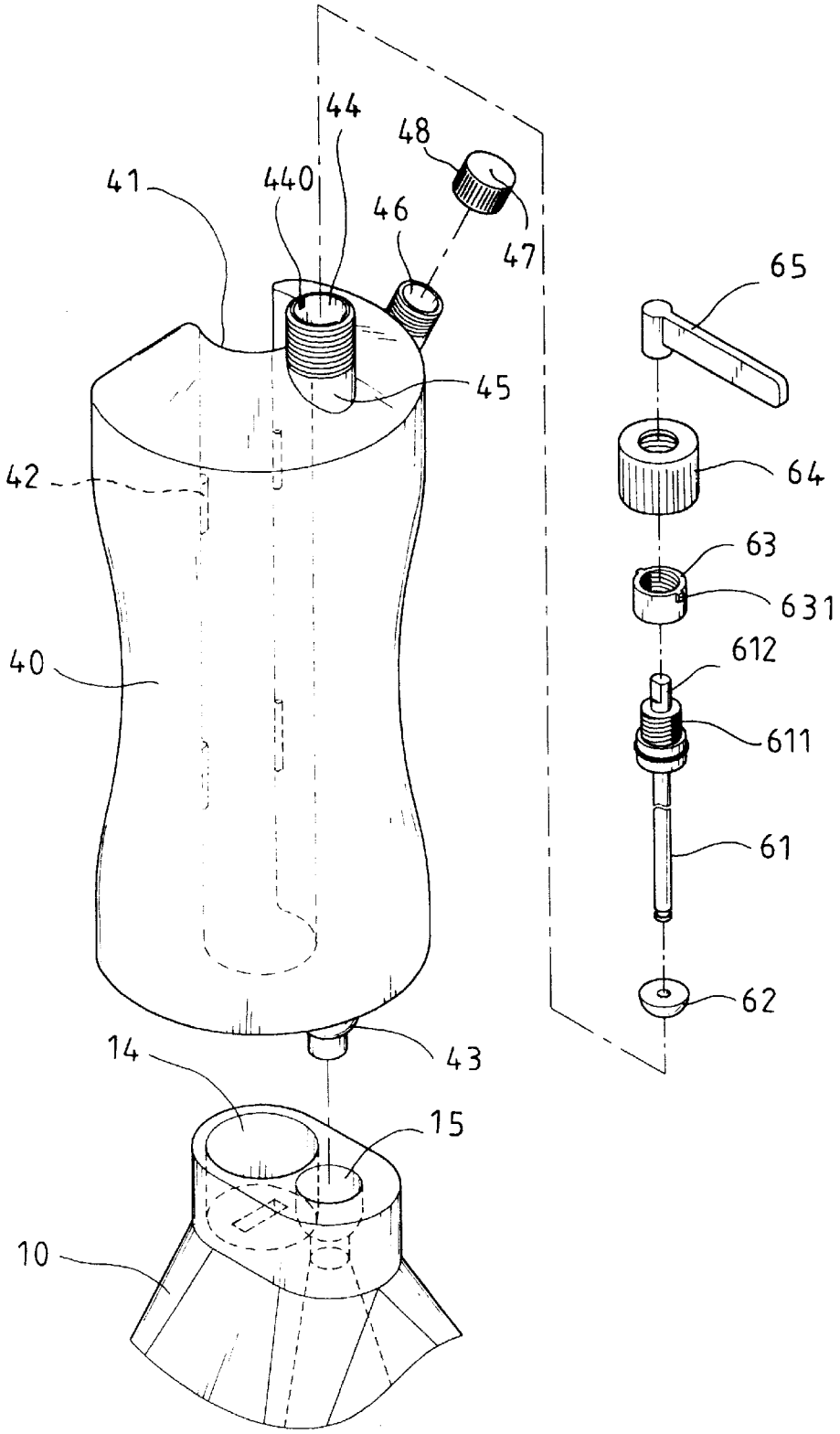
FIG. 3 is an exploded view of a control assembly to be received in the tank of the invention.
Figure 4:
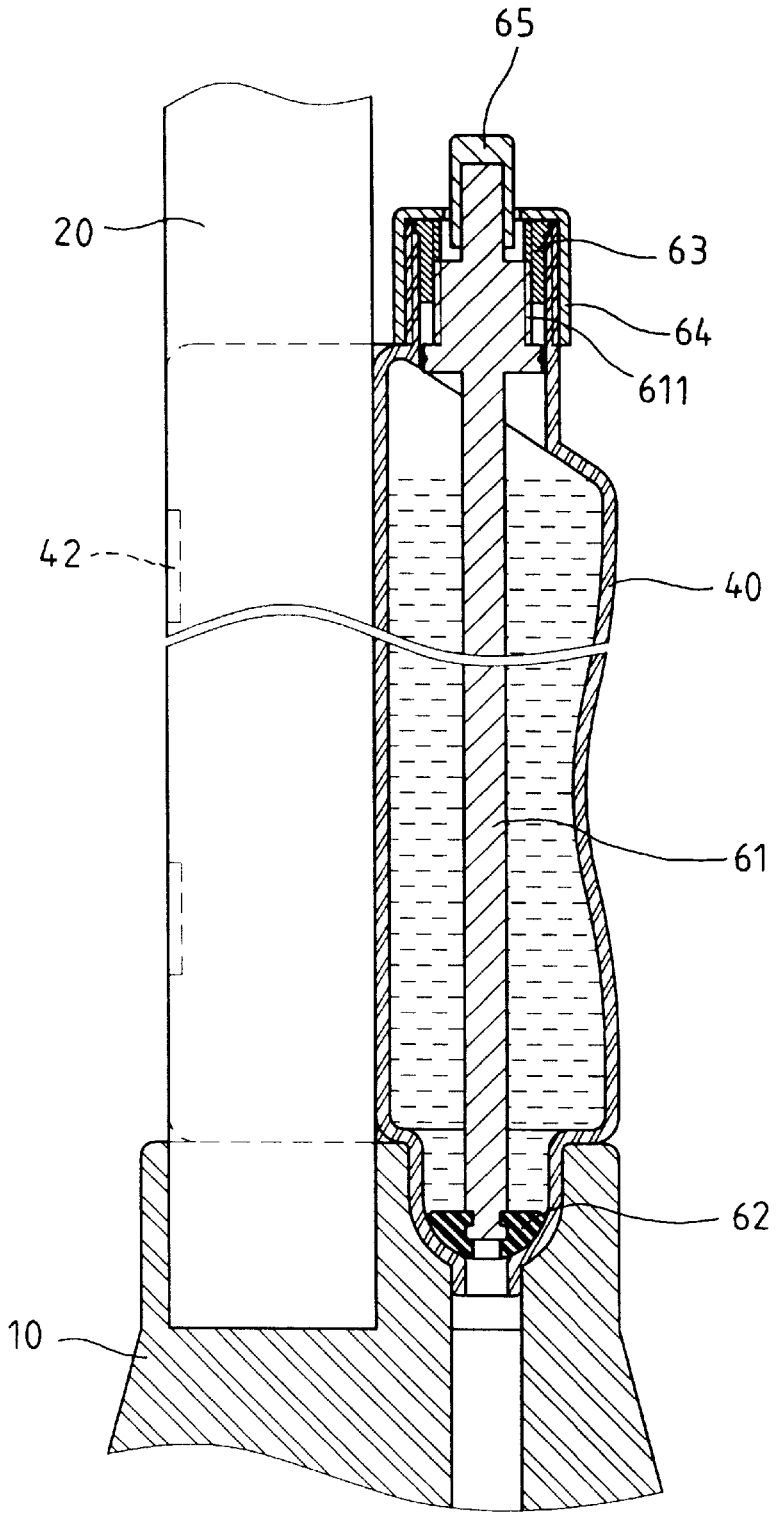
FIG. 4 is a side cross sectional view to show the control assembly which seals an outlet of the tank.
Figure 5:
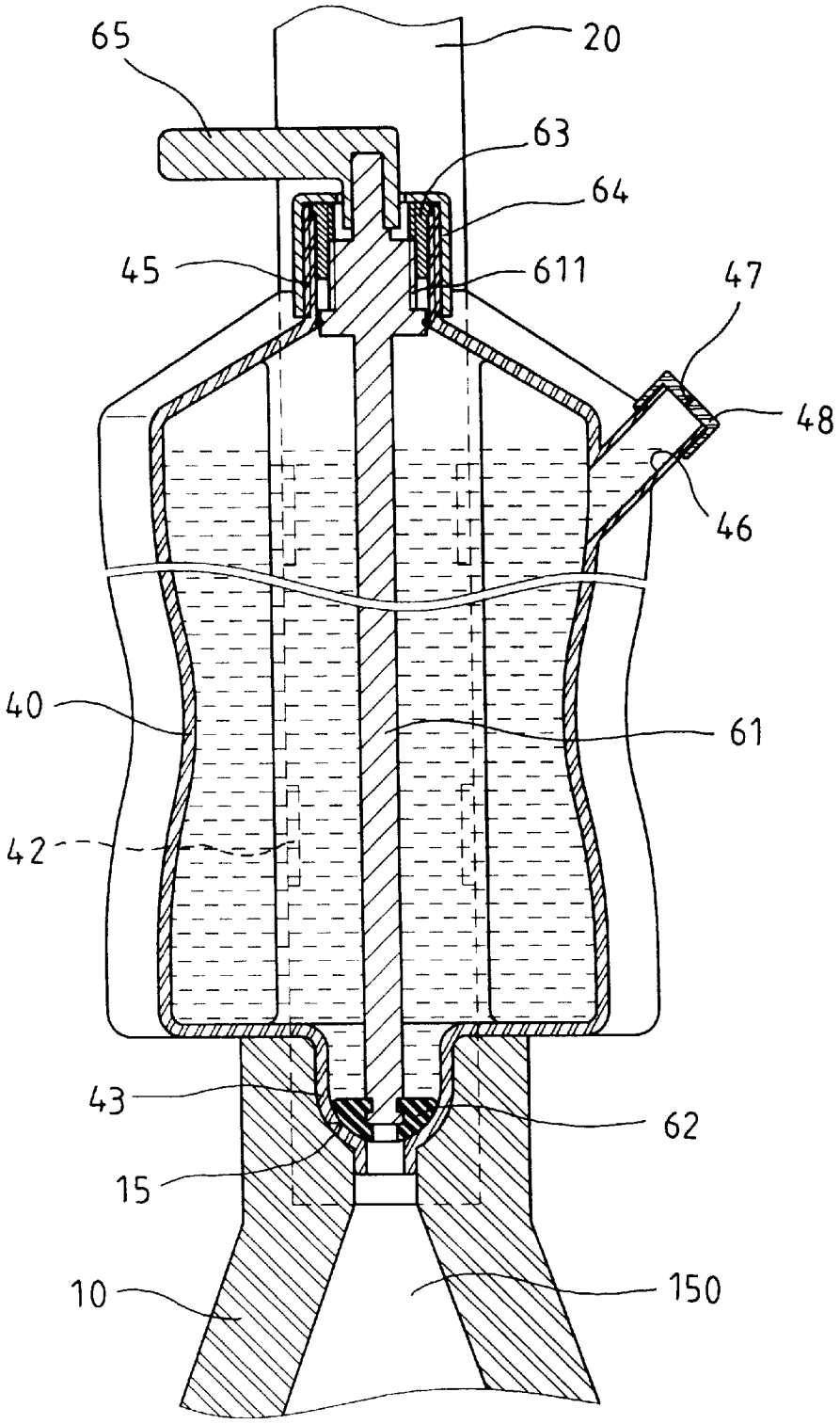
FIG. 5 is a front cross sectional view to show the control assembly which seals an outlet of the tank.
Figure 6:
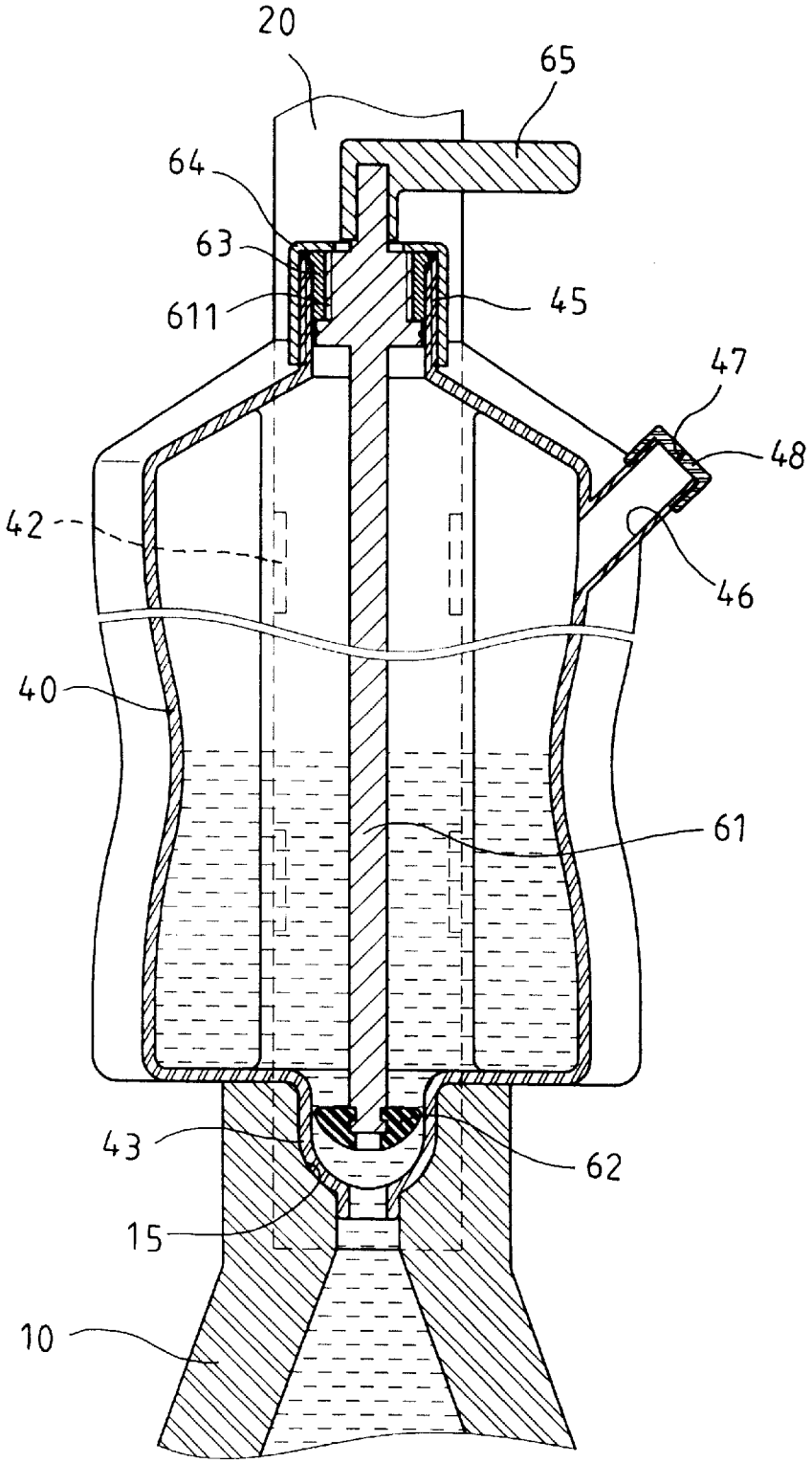
FIG. 6 is a front cross sectional view to show the control assembly which is operated to open the outlet of the tank.
Figure 7:
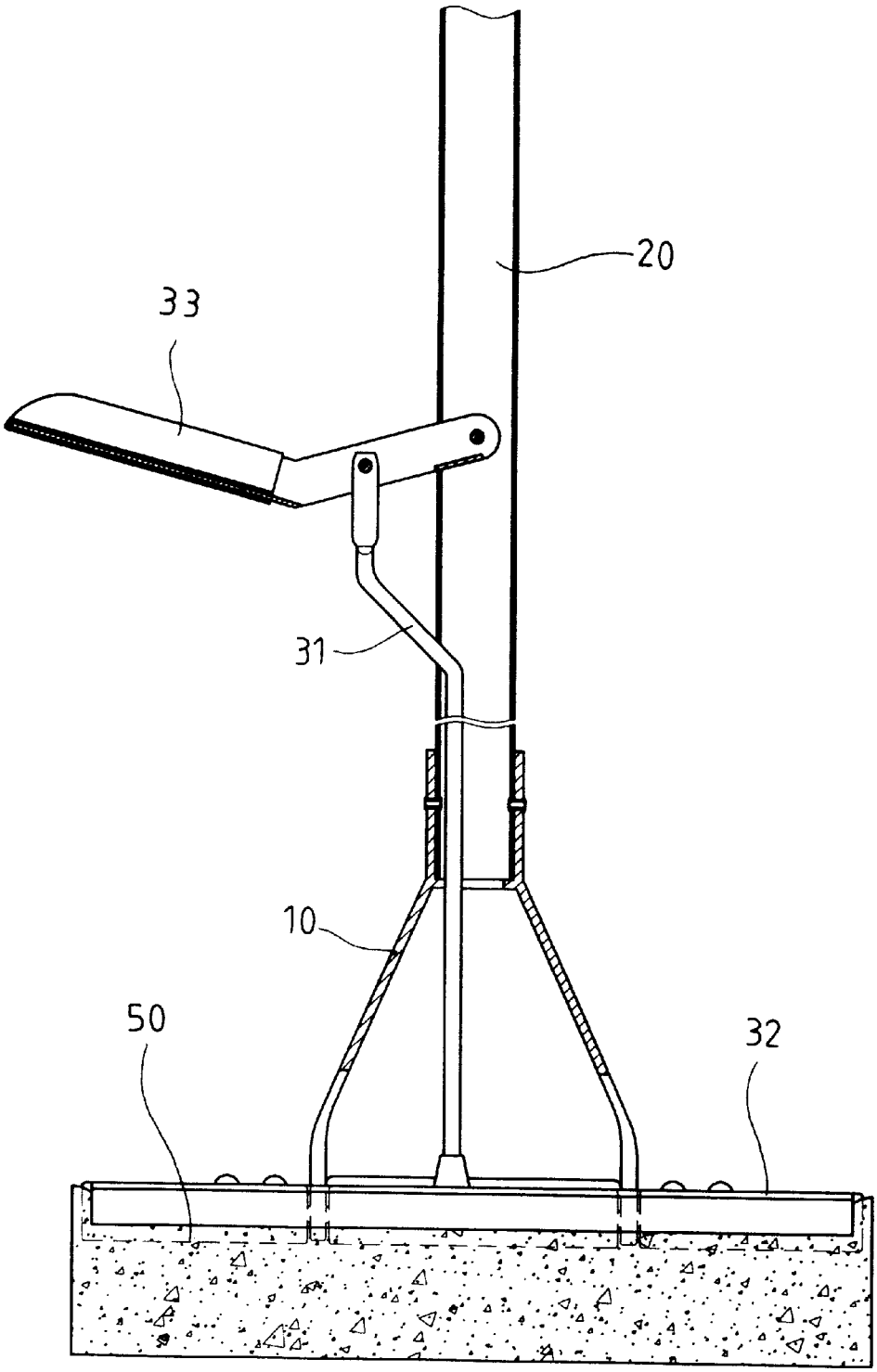
FIG. 7 is a plan view to show the sponge mop when the lever handle is not lifted.
Figure 8:
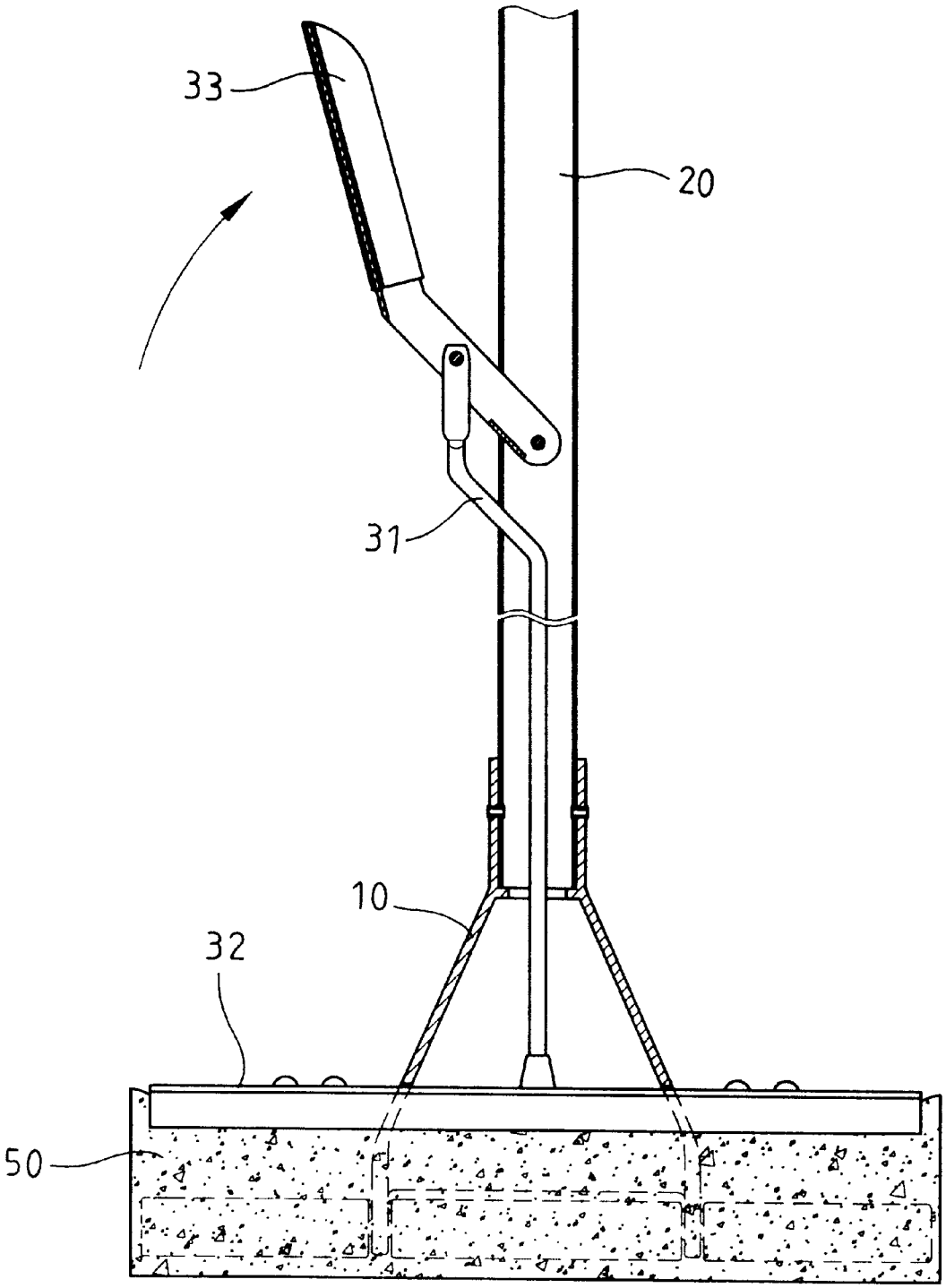
FIG. 8 is a plan view to show the sponge mop when the lever handle is lifted and the sponge is squeezed by rollers.
Figure 9:
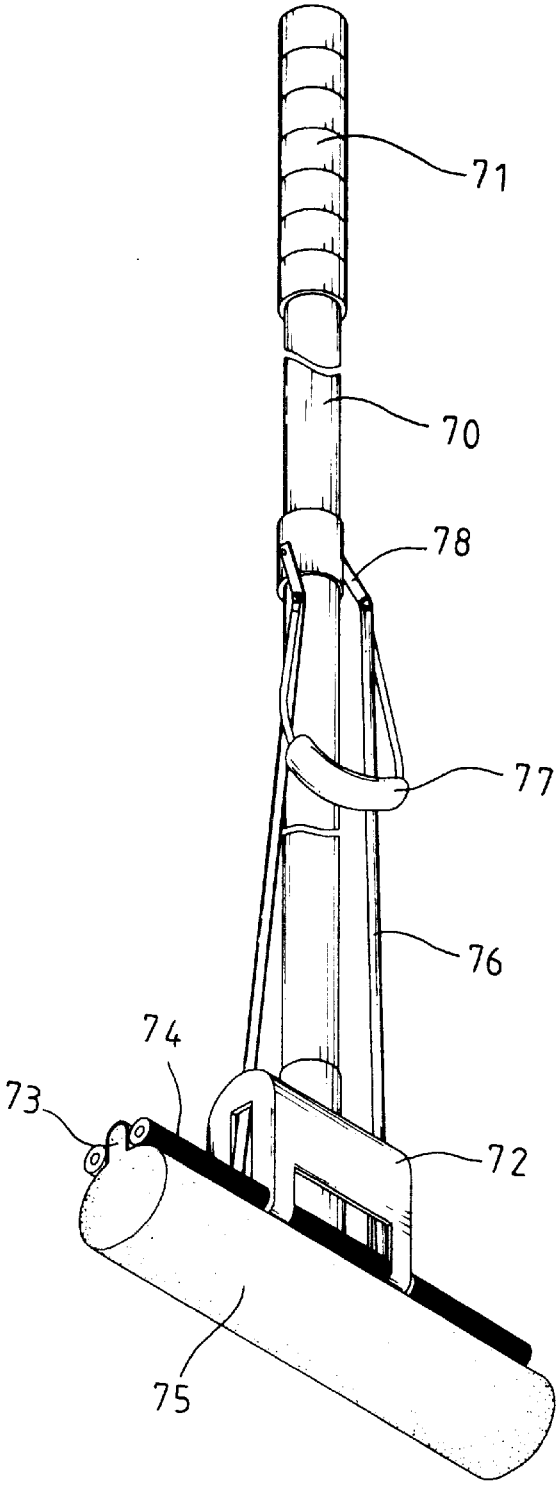
FIG. 9 PRIOR ART
FIG. 9 is a perspective view to show a conventional sponge mop.

As shown in FIG. 6, when rotating the operation handle 65, the threaded portion 611 of the rod 61 is moved upward and the seal member 62 is removed from the outlet 43 so as to let detergent in the tank 40 flow to the sponge 50 via a guide path 150 (as shown in FIG. 2) defined in an inside of the frame 10. Of course, as shown in FIGS. 7 and 8, when pulling the lever handle 33, the sponge 50 is lifted and is squeezed by the rollers 12.

The lever handle 65 is easily operated and the tank 40 is simply pushed to be connected to the post 20 so that it is a user friendly design. The detergent can be filled via the inlet 46 of the tank 40 to enforce cleaning feature of the sponge mop.

While we have shown and described various embodiments in accordance with the present invention, it should be clear to those skilled in the art that further embodiments may be made without departing from the scope and spirit of the present invention.

What is claimed is:

1. A sponge mop comprising:

a post having a first end extending through a top of a frame, said frame having two extensions and each extension having a roller connected thereto, a sponge is located between said two extensions and a ridge extending from a top of said sponge, said ridge movably located between said two extensions of said frame, a hole defined through a top of said frame and a guide path defined through said frame, said guide path communicating with said hole in said top of said frame;

a lever handle pivotally connected to said post and a link fixedly connected between said lever handle and said ridge, and a tank connected to said post and having an outlet extending from a lower end of said tank, said outlet engaged with said hole in said frame and a seal member removably engaged with said outlet, a top hole defined in a top of said tank and a control assembly received in said tank, a lower end of said control assembly connected to said seal member and an operation handle on a top of said control assembly which is engaged with said top hole.

2. The sponge mop as claimed in claim 1, wherein said post has a slot defined in a periphery thereof and an end of said lever handle inserted in said slot and pivotally connected to said post, said link movably received in said post via said slot.

3. The sponge mop as claimed in claim 1 further comprising a groove defined in a side of said tank and said post engaged with said groove of said tank.

4. The sponge mop as claimed in claim 3 further comprising protrusions extending from an inside of said groove to let said post be securely engaged with said groove.

5. The sponge mop as claimed in claim 1 further comprising an inlet defined in said top of said tank.

6. The sponge mop as claimed in claim 1 wherein said control assembly comprises a rod and a lower end of said rod is fixedly connected to said seal member, a threaded portion on a top end of said rod and an engaging end extending from a top end of said rod, said engaging end extending from said-top hole and said operation handle connected to said engaging end, a collar fixedly engaged with said top hole and having a threaded inner periphery, said threaded portion threadedly engaged with said threaded inner periphery of said collar.

7. The sponge mop as claimed in claim 6 further comprising two bosses extending radially outward from said collar and two notches defined in an inner periphery of said top hole so that said two bosses are engaged with said two notches.

* * * * *